United States Patent [19]

Randolph

[11] Patent Number: 5,008,551

[45] Date of Patent: Apr. 16, 1991

[54] PHOSPHORESCENT LUMINOUS DOOR KNOBS COVER

[76] Inventor: Timothy T. Randolph, 1415 Alameda Dr. S., Lakeland, Fla. 33805

[21] Appl. No.: 352,805

[22] Filed: May 16, 1989

[51] Int. Cl.[5] ..... F21K 2/00

[52] U.S. Cl. ..... 250/462.1; 250/466.1; 16/121

[58] Field of Search ..... 250/462.1, 466.1, 463.1, 250/467.1, 462.1; 542/40; 16/121

[56] References Cited

U.S. PATENT DOCUMENTS

| | | | |
|---|---|---|---|
| 1,342,777 | 6/1920 | Thorne | 250/466.1 |
| 1,522,169 | 1/1925 | Young | 250/466.1 |
| 1,590,629 | 6/1926 | Julius | 16/121 |
| 2,032,540 | 3/1936 | Hodny et al. | 250/466.1 |
| 2,085,331 | 6/1937 | Ramlau | 250/466.1 |
| 2,155,449 | 4/1939 | Seaman | 250/462.1 |
| 2,341,583 | 2/1944 | Tuve | 250/462.1 |
| 2,360,516 | 10/1944 | Schmidling | 250/462.1 |
| 2,431,169 | 11/1947 | Dice | 250/462.1 |
| 2,558,433 | 6/1951 | Heinz | 250/466.1 |
| 2,588,183 | 3/1952 | Vigon | 250/462.1 |
| 3,174,788 | 3/1965 | Williams | 16/121 |
| 4,082,351 | 4/1978 | Chrones | 16/121 |
| 4,745,286 | 5/1988 | Jones | 250/462.1 |
| 4,832,214 | 5/1989 | Schrader et al. | 215/11.1 |

*Primary Examiner*—Edward P. Westin
*Assistant Examiner*—Kim-Kwok Chu
*Attorney, Agent, or Firm*—Joseph C. Mason, Jr.; Ronald E. Smith

[57] ABSTRACT

A luminescent door knob cover. The cover is molded from an admixture of a phosphorescent powder and a carrier. A first half of the cover overlies a first half of a door knob and the first half of a door knob neck when the device is operatively installed. A second half of the cover overlies a second half of the door knob and the second half of the door knob neck when the device is operatively installed. A hinge is formed in the cover to facilitate placing it on and removing it from door knobs. An annular band secures the cover to the door knob.

4 Claims, 3 Drawing Sheets

Fig. 1
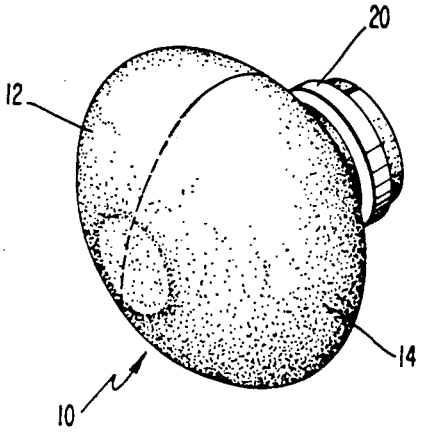
Fig. 2
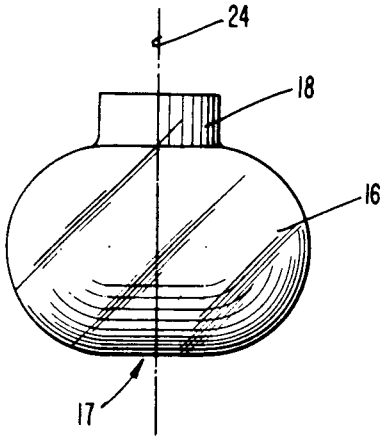
Fig. 3
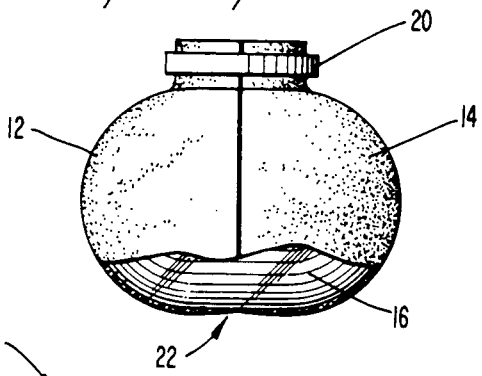
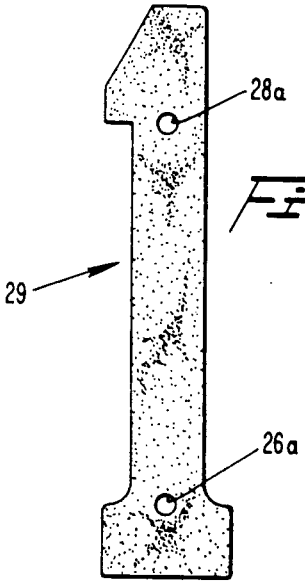
Fig. 4
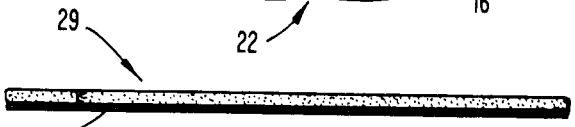
Fig. 7
Fig. 5
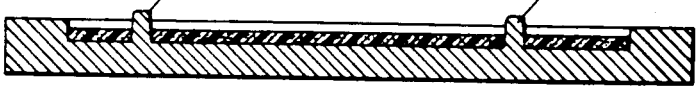
Fig. 6
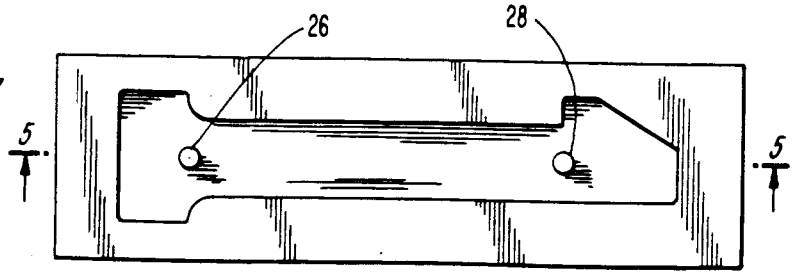

Fig. 9
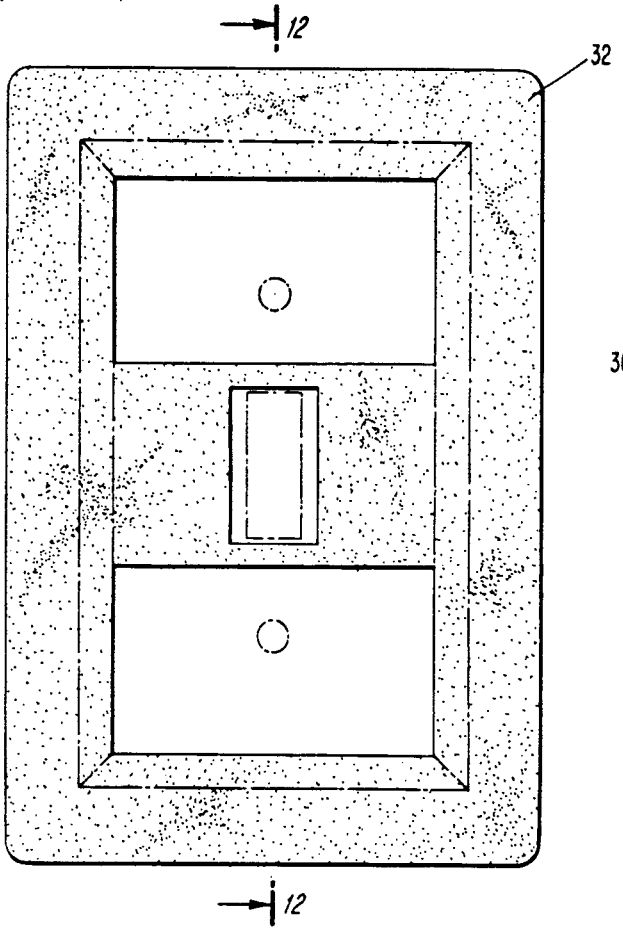
Fig. 8
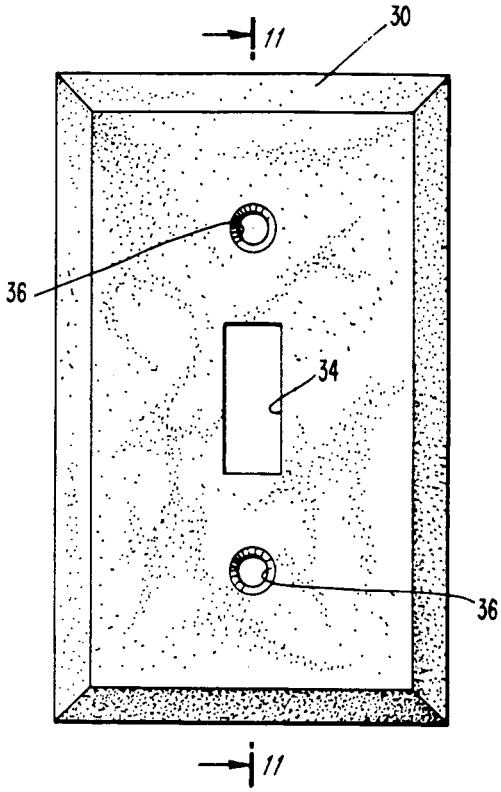
Fig. 10
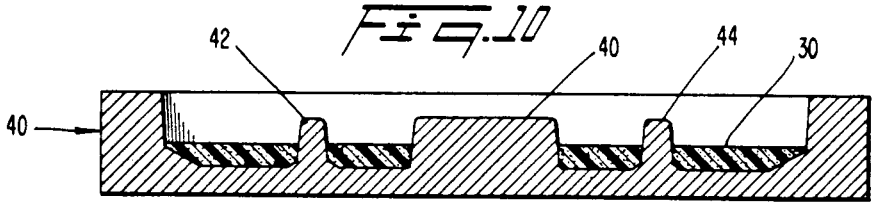
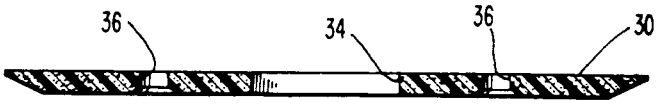
Fig. 11
Fig. 12
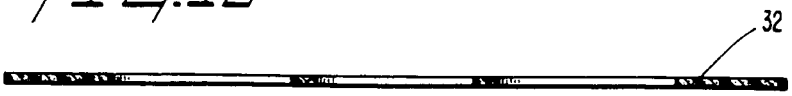

PHOSPHORESCENT LUMINOUS DOOR KNOBS COVER

TECHNICAL FIELD

This invention relates to self-luminous devices. More particularly, it relates to luminous door knob covers, light switch plates and other articles, such as house address numerals, formed of luminous or phosphorescent materials.

BACKGROUND ART

Energy can be saved in areas that do not require full illumination by providing luminescent articles in those areas. Luminescent articles can be placed indoors, for example, and save energy by eliminating the need for night lights. Night lights are also somewhat unsafe because they must be plugged in and a night light's electrical cord presents a tripping hazard.

There are commercially available phosphorescent powders that can be admixed with suitable carrier means to produce a paste that can be applied to various articles to produce a glow effect when the treated article is in darkness.

For example, glow in the dark key chain ornaments are made by adding a phosphorescent powder to the plastic before it is hardened. The known key chain ornaments, however, glow in the dark for no more than an hour or two.

There is a need, perceived by the present inventor, to expand the use of radiant powers beyond their current limited usages.

For example, emergency rescue services often have difficulty in locating street addresses at night because few house numbers are illuminated. Moreover, there are no known self-luminescent house address numerals. It is known that a home owner could purchase one of the commercially available powders, mix a appropriate amount thereof with a suitable carrier, and attempt to apply the resulting mixture to conventional house address numbers, but there are numerous shortcomings with such approach. For example, the radiant powder is sold in bulk, without instructions for its use. This is because it is normally sold to manufacturing concerns that simply charge the powder into the plastic or other raw materials being used to produce the manufacturer's products. Thus, a home owner will not know what kind of carrier to use, what amount of powder to put into the carrier, or how to apply the powder-containing carrier to the house address numerals once the mixture has been prepared. Luminescence is also commercially available as an acrylic water base paint, but the paint does not stand up well and its luminescence weakens significantly over time.

Moreover, if the homeowner later elects to remove the luminous substance for any reason, unless he or she knows how to apply the radiant mixture in a manner that permits its removal, the desire to remove the same will be frustrated.

For these and other reasons, homeowners have not purchased the radiant powder and applied it, with a carrier, to house address numerals, light switch plates, door knobs and the like.

Accordingly, there is a need for methods whereby homeowners can make their own luminescent house numerals and whereby homeowners can prepare phosphorescent mixtures for application to miscellaneous articles.

There is also a need for self-luminescent house address numerals, light switch cover plates and the like that consumers can purchase for installation in their homes, without having to go through the trouble of making their own articles.

Moreover, luminescent articles have utility in vehicles, schools, hospitals and other institutions. Elderly people with failing eyesight are also comforted by the sight of glow-in-the-dark objects.

The prior art is also devoid of items such as luminescent door knob covers that can be attached to and easily removed from door knobs.

DISCLOSURE OF INVENTION

The following description discloses methods whereby homeowners can make their own luminescent house address numerals and other luminescent objects such as light switch cover plates.

It also discloses a unique luminescent door knob cover that is hingedly formed so that it can be placed onto and removed from a conventional door knob.

In one embodiment of the invention, phosphorescent powder in a predetermined amount is admixed with a quick drying clear epoxy of the type that dries in five to ten minutes. The mixture is prepared in a mold having the shape of a house address numeral so that when the epoxy hardens, it is removed from the mold and is securable to a house by suitable means.

In another embodiment, a similar mixture is poured into a conventional light switch cover plate that has been modified by adding a wall to its peripheral borders to convert it into a mold. In this manner, when the epoxy has hardened, a selfluminescent light switch cover plate is produced. In addition to epoxy, many other carrier means are available. For example, polyurethane, acrylics, silicone and other polymers are within the contemplation of this invention.

A primary object of this invention is to provide luminescent house address numerals, light switch cover plates, luminescent door knob covers, and the like.

Another important object is to disclose practical methods for making such devices.

The invention accordingly comprises the features of construction, combination of elements and arrangement of parts that will be exemplified in the descriptions set forth hereinafter and the scope of the invention will be set forth in the claims.

DESCRIPTION OF THE DRAWINGS

For a fuller understanding of the nature and objects of the invention, reference should be made to the following detailed description, taken in connection with the accompanying drawings, in which:

FIG. 1 is a perspective view of the novel door knob cover of this invention;

FIG. 2 is a plan view of a door knob;

FIG. 3 is a plan view of a door knob that is covered by the door knob cover of this invention;

FIG. 4 is a plan view of a self-luminescent house address numeral;

FIG. 5 is a sectional view taken along line 5—5 in FIG. 6;

FIG. 6 is a plan view of a mold that produces the house address numeral shown in FIG. 4;

FIG. 7 is a side elevational view of an alternative embodiment of the house address numeral shown in FIG. 4;

FIG. 8 is a light switch cover plate formed of luminescent materials;

FIG. 9 is a plan view of a luminescent frame for a light switch cover plate;

FIG. 10 is a sectional view of a mold that produces the light switch cover plate of FIG. 8;

FIG. 11 is a sectional view taken along line 11—11 in FIG. 8;

FIG. 12 is a sectional view taken along line 12—12 in FIG. 9;

Similar reference numerals refer to similar parts throughout the several views of the drawings.

BEST MODES FOR CARRYING OUT THE INVENTION

Figure 13:
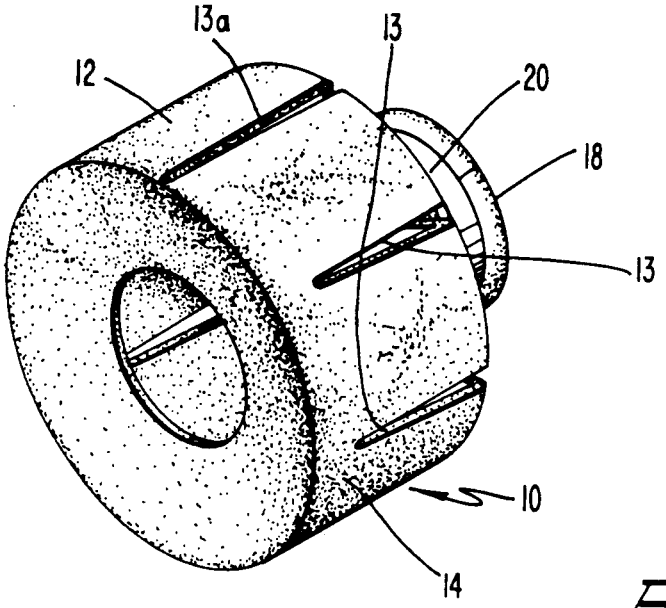
FIG. 13 is a perspective view of an alternative embodiment of the novel door knob cover.

Referring now to FIGS. 1-3, it will there be seen that the novel self-luminescent door knob cover of this invention is denoted by the reference numeral 10 as a whole.

Cover 10 has two primary parts, denoted 12, 14; the parts exhibit bilateral symmetry with respect to one another, i.e., parts 12, 14 are mirror images of one another.

Accordingly, each part has a door knob-receiving part 16, 16 and a door knob-neck receiving part 18, 18.

An annular band member 20 overlies the neck parts 18, 18 when the door knob has been installed to maintain parts 12, 14 in juxtaposition to one another.

A hinge means 22 is formed in the flat part of door knob-receiving part 16, 16 as shown; accordingly, parts 12, 14 are separated, placed over the door knob, and brought back together to capture the door knob therebetween. Annular band 20, provided in the form of a flexible strip, is then wrapped about the neck parts 18, 18; the opposite ends of band 20 are provided with suitable fastening means to facilitate its positioning around the neck of the cover 10.

Door knob cover 10 is made by placing about one teaspoon of radiant, phosphorescent powder in a carrier of high efficiency clear epoxy that dries in five to ten minutes. A uniform thickness of the carrier/powder admixture is applied with a paint brush or other suitable instrument to all of the door knob and neck to be covered, with the exception that no admixture is applied where an imaginary vertical plane 24 passes through the door knob and its neck and with another exception that a very thin layer of the mixture is applied to the flat part 17 of the door knob where hinge means 22 is to be formed. Stated in positive terms, the admixture is applied in a thin layer only along a diameter of the flat part 17 of the door knob to produce hinge 22, and is applied in a thicker layer along opposite sides of the door knob and neck 18 with a line of demarcation therebetween where no admixture is applied to produce the parts 12, 14 having bilateral symmetry.

FIGS. 5 and 6 depict an emulsion of radiant powder and a carrier such as quick drying clear epoxy in a mold for forming the numeral one. About two teaspoons of the radiant powder are added to the epoxy before it hardens. The mold includes a pair of post members 26, 28; accordingly, a numeral removed from a mold will have a pair of bores 26*a*, 28*a* formed therein as shown in FIG. 4 to facilitate attachment of the numeral by a homeowner to a support surface. Alternatively, or additionally, the numerals may be affixed to a suitable support surface with commercially available double sided pressure sensitive tape 27 as depicted in FIG. 7. Since the entire numeral 29 is formed of the admixture or emulsion and not just coated with it, the numerals, when fully charged, will glow all night long.

A light switch cover plate 30 formed of luminescent materials is shown in FIGS. 8 and 11. FIG. 10 shows the mold 32 into which is poured an admixture of the phosphorescent powder and quick drying clear epoxy polymer or other suitable carrier means to produce cover plate 30. A rectangular block 40 and posts 42, 44 are provided to produce light switch and screw-receiving apertures, denoted 34 and 36, 36 respectively. The resulting cover plate 30 is formed entirely of the powder-/epoxy mixture and, like the novel house address numerals, will glow all night.

Mold 32 can also be made from a conventional light switch cover plate. Upstanding wall members are added to the peripheral borders thereof and block 40 and posts 42, 44 are added thereto along the longitudinal axis of symmetry thereof. The resulting structure is substantially similar to mold 32 and, accordingly, FIG. 10 should be understood as disclosing said mold.

A self-luminescent frame 38 that can frame cover plate 30 or a conventional, non-luminescent cover plate is shown in FIG. 9 and its cross section is depicted in FIG. 12.

Having disclosed house numerals and light switch cover plates and cover plate frames made entirely of radiant powder/clear epoxy, as well as a novel door knob cover being made entirely of such substance, it is now clear that the number of items that can be formed is unlimited.

Figure 14:
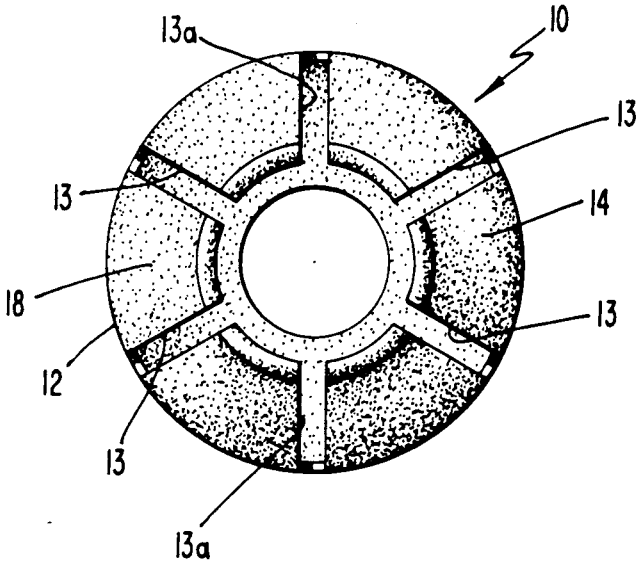
FIG. 14 is a front elevational view of the cover of FIG. 13.
Figure 15:
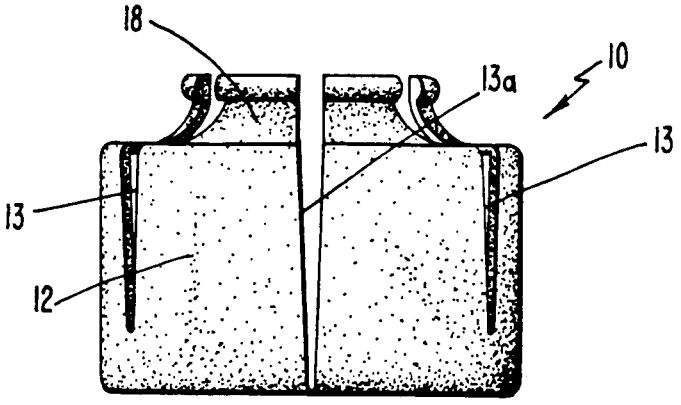
FIG. 15 is a side elevational view of the cover of FIG. 13.

For example, as shown in FIGS. 13-15, a door knob cover of the type used to prevent children from opening doors may also be formed of luminescent materials. Radial slits 13 facilitate the opening of the cover 10 so that it is positionable over a door knob. Slits 13*a* are deeper than the other slits so the cover 10 still has two primary halves 12 and 14.

The radiant powder which has been found to be most effective is manufactured by Perma-Glow Corporation, 3111 Camino, Del Rio, CA 92108.

Although all embodiments have been disclosed as having a carrier of quick drying clear epoxy, other carrier means could be employed. Numerous plastic formulations could be employed, for example. Polyurethane may also be used as a suitable carrier. Elmer's® Glue and other commercially available adhesives also adequately perform the carrier function.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

I claim:

1. A luminescent door knob cover comprising:

a first rigid cover member having a first part that conforms to a first half of a door knob and having an integral second part that conforms to a first half of a door knob neck;

a second rigid cover member having a first part that conforms to a second half of said door knob and having an integral second part that conforms to a first half of said door knob neck;

said first and second parts of said respective first and second cover members being formed entirely of a hardened carrier means having phosphorescent powder admixed therein;

said carrier means having a predetermined thickness;

an annular band disposed in circumscribing relation to said integral second parts of said first and second cover members when said first and second cover members are disposed in overlying relation to said door knob and in confronting relation to one another;

said first and second cover members exhibiting bilateral symmetry with respect to one another;

a parting line being formed where said first and second cover means meet when disposed in confronting relation to one another;

a hinge means hingedly connecting together said first and second cover members;

said hinge means being formed at a preselected location in axial alignment with said parting line; and said hinge means being formed by a substantially reduced thickness of said carrier means.

2. The cover of claim 1, wherein said luminescent material is formed by admixing a predetermined amount of a radiant powder and a predetermined amount of a quick drying clear epoxy.

3. The cover of claim 1, wherein said luminescent material is formed by admixing a predetermined amount of a phosphorescent powder and a predetermined amount of polyurethane.

4. The cover of claim 1, further comprising an annular band disposed in surrounding relation to a neck part of said first and second cover members when said first and second cover members are disposed in overlying relation to a door knob and door knob neck.

* * * * *